US007393124B1

(12) United States Patent
Williams

(10) Patent No.: US 7,393,124 B1
(45) Date of Patent: Jul. 1, 2008

(54) ARCHITECTURAL MAST-MOUNTED SUPPORT SYSTEM

(76) Inventor: Kenneth Riley Williams, 7550 Williamsberg Dr., Cumming, GA (US) 30041

( * ) Notice: Subject to any disclaimer, the term of this patent is extended or adjusted under 35 U.S.C. 154(b) by 200 days.

(21) Appl. No.: 11/120,449

(22) Filed: May 4, 2005

(51) Int. Cl.
*F21S 13/10* (2006.01)
*F21S 8/04* (2006.01)

(52) U.S. Cl. ..... 362/431; 362/403

(58) Field of Classification Search ..... 362/431, 362/403, 385, 401, 288, 402
See application file for complete search history.

(56) References Cited

U.S. PATENT DOCUMENTS 2,889,095 A * 6/1959 Reinhold et al. ..... 224/257
3,670,159 A * 6/1972 Millerbernd ..... 200/2
3,673,403 A * 6/1972 Woods ..... 362/403
3,686,498 A * 8/1972 Meyer ..... 52/40
3,696,241 A * 10/1972 Meyer et al. ..... 362/250
3,801,813 A * 4/1974 Kiehn ..... 362/391
3,805,054 A * 4/1974 Wolf ..... 362/403
3,847,333 A * 11/1974 Zeller ..... 362/269
3,911,267 A * 10/1975 Kiehn ..... 362/282
4,092,707 A * 5/1978 Millerbernd ..... 362/391
4,115,845 A * 9/1978 Blahut ..... 362/403
4,198,022 A * 4/1980 Pletcher et al. ..... 248/320
4,228,488 A * 10/1980 Garchinsky ..... 362/250
4,234,165 A * 11/1980 Murray et al. ..... 248/404
4,237,530 A * 12/1980 Murray et al. ..... 362/403
4,348,717 A * 9/1982 Thompson ..... 362/403
4,429,355 A * 1/1984 Garchinsky ..... 362/403
4,661,894 A * 4/1987 Chenot ..... 362/403
4,851,980 A * 7/1989 McWilliams et al. ..... 362/403
5,628,558 A * 5/1997 Iacono et al. ..... 362/288
5,918,970 A * 7/1999 Brohard et al. ..... 362/370
5,975,726 A * 11/1999 Latimer ..... 362/384
6,074,075 A * 6/2000 Staniec ..... 362/250

* cited by examiner

*Primary Examiner*—Jong-Suk (James) Lee
*Assistant Examiner*—Leah S Lovell
(74) *Attorney, Agent, or Firm*—Kenneth E. Darnell

(57) ABSTRACT

A support assembly capable of being raised and lowered on a mast and configured in a compact, volumetrically efficient conformation lending architectural significance to the appearance of the support assembly when used to mount a plurality of luminaires or other apparatus intended for use in a location above a surface, such as the surface of the earth, the invention permits remote latching and unlatching of the support assembly through use of an improved latching mechanism having dimensions permitting housing of the latching mechanism within an enclosure of a reduced height, thereby lending an esthetically pleasing appearance to a mast-mounted support arrangement relative to prior art assemblies intended to perform similar functions.

12 Claims, 6 Drawing Sheets

ARCHITECTURAL MAST-MOUNTED SUPPORT SYSTEM

BACKGROUND OF THE INVENTION

1. Field of the Invention

The invention relates generally to mechanisms employed to raise and lower groupings of luminaires or other apparatus mounted to a support assembly and positionable at or near a distal end of a mast such as a high mast as is useful for illumination of a roadway or the like, the invention particularly relating to a latching mechanism of compact conformation permitting configuration of a relatively low profile support assembly having improved operation and esthetic appeal.

2. Description of the Prior Art

Clusters of luminaires intended for outdoor illumination have long been mounted to a support ring capable of being hoisted to or near the top of a "high mast", typically through use of a winch and associated hoisting cables, the support ring being readily lowered for necessary maintenance, repair or replacement of the luminaires. In certain applications, devices other than luminaires are mountable by a support ring for raising/lowering of the resulting assembly along a high mast, reference herein to luminaires so mounted encompassing such other devices. In accomplishment of the functions so noted, the support ring carrying the luminaires must be mounted for movement along the mast between a lowermost or ground-level position necessary for servicing and the like and an operational uppermost position at or near the top of the mast at which the luminaire-bearing support ring is releasably yet positively latched to a stationary support permanently located at an upper portion of the mast. Latching mechanisms typically employed for accomplishing such functions include a latch pin carried by the support ring, such latch pins engaging latch barrels mounted to the stationary support permanently mounted at the top of the mast. Mating of a number of the latch pins with a corresponding number of the latch barrels on completion of the hoisting operation results in positive engagement between the latch pins and the latch barrels sufficient to latch the support ring to the stationary support until disengagement to allow the luminaire-bearing support ring to be lowered back to the ground as desired. Latch barrels such as are common in the prior art are mounted substantially vertically with openings disposed downwardly to permit receipt of one each of the latch pins into said opening as the latch pins engage the latch barrels, the latch pins being necessarily oriented in a vertical sense in order to provide the desired function. Vertical orientation of the latch pins and latch barrels unavoidably cause the assembly resulting from the mating of the support ring and stationary support to be less than compact in "height", thereby lending a bulky appearance to the resulting assembly. Prior high mast lighting systems, while functional mechanically and useful for accomplishment of intended operation, have not generally exhibited esthetic appeal due at least in part to an unavoidable height dimension relative to other dimensions of known support ring/stationary support assemblies. Further, mechanical subassemblies of prior art systems are typically exposed to view and are therefore lacking in esthetic appeal. An architecturally appealing high mast hoisting system could be realized by the ability to reduce the height of such assemblies along with the ability to cleanly mate the support ring with the stationary support so that the assembly appears as an essentially unitary enclosure or housing from which luminaire-mounting arms cleanly and attractively extend for mounting of luminaires or the like. Attainment of an architecturally appealing structure at reduced cost lends increased improvement over the prior art, such cost reduction being realized in part by elimination of costly and bulky latch barrels. Such bulky latch barrels, when exposed to view, are lacking in esthetic appeal. Prior art difficulties associated with jamming of latch pins with camming surfaces disposed within the interior of latch barrels would preferably be avoided by improved latch pin structure having cam-following pins positively engageable with such camming surfaces without the tendency to "cock" or tilt with resultant jamming.

The prior art is replete with systems proposed for use and which are actually used for raising and lowering luminaire assemblies along high mast poles, such prior systems being deficient in esthetic appeal as alluded to hereinabove. Typical prior art systems include that system described by Murray et al in U.S. Pat. No. 4,234,165, in which a circular support ring carrying luminaires is hoisted along a high mast pole to an operational position adjacent a cylindrical housing disposed atop the pole, the housing covering a stationary support. The support ring simply abuts the housing and is not esthetically pleasing in appearance. Luminaires carried by a support ring are raised and lowered according to the teachings of Garchinsky in U.S. Pat. No. 4,228,488, the support ring abutting a housing covering a stationary support mounted atop a high mast pole on completion of the raising function, the result being less than esthetically pleasing. Latimer, in U.S. Pat. No. 5,975,726 discloses a high mast lighting system comprised of a luminaire-bearing annular support ring which fails to visually integrate with a covering housing fixed atop a high mast pole on hoisting of the support ring to an operational position adjacent the housing. Blahut, in U.S. Pat. No. 4,115,845, fails to provide a high mast system with visual appeal. Garchinsky, in U.S. Pat. Nos. 4,149,230 and 4,429,355 discloses high mast assemblies of conventional appearance. The appearance of the high mast systems disclosed by Richter in U.S. Pat. No. 6,261,122 and Thompson in U.S. Pat. No. 4,139,884 is essentially less than pleasing as are the systems disclosed by Staniec in U.S. Pat. No. 6,074,075; Hunt et al in U.S. Pat. No. 3,633,980; Savoca in U.S. Pat. No. 5,718,602; Richter in U.S. Pat. No. 6,261,122 and Thompson in U.S. Pat. No. 4,348,717 inter alia.

The art has experienced a long-felt need for a high mast hoisting system having architectural esthetics as well as a favorable cost profile. The present high mast system addresses such needs by providing a luminaire-bearing support ring of a shape and dimensions permitted in part by a low profile latching mechanism that further permits economies of cost in the construction of a system used in environments within which the invention is intended.

SUMMARY OF THE INVENTION

The invention provides architecturally significant and visually esthetic apparatus such as finds utility in high mast use environments wherein luminaires and the like are mounted in clusters to a support structure movable along a vertical pole between a lowermost position and an operational position at or near a distal end of the pole. A luminaire support base movable along the pole by means of a conventional winch and cable arrangement is raised into adjacent relation to a stationary support housing fixed to the pole at or near the distal end of the pole. The support base releasably and positively latches to the stationary support housing by means of at least one low profile latching mechanism, a portion of the latching mechanism including a cam-following pin slidable within a pin housing carried by the movable support base while a cam plate having camming surfaces formed therein. The pin engages the camming surfaces and slides within the pin housing to assume a position whereby the support base latches to the support housing in a contiguous relationship whereby the support base visually integrates with the support housing to provide an esthetically pleasing appearance.

The latching mechanism of the invention is configured in a compact, volumetrically efficient conformation having a particularly low profile in the height dimension, this height dimension being reduced relative to prior art latching mechanisms thereby permitting an assembly formed of the support base and the support housing to be of a reduced height relative to the height for "thickness" of prior art assemblies. The reduced profile of the present assembly formed of the support base and support housing lends a more esthetically pleasing appearance to the present assembly and permits in part design of an architecturally desirable high mast system. The present latching mechanism is also less costly to fabricate while exhibiting improved operational capability, the structure of the present latching mechanism being less likely to jam during latching and unlatching operation than at least certain prior art latching mechanisms used in high mast applications. The present latching mechanism therefore constitutes improvement in the art by virtue of high reliability and low cost as well as by virtue of compact low profile conformation permitting configuration of an esthetically pleasing architecturally significant high mast system. The support base and the housing support are preferably conformed as rectangular solids, particular square in lateral section, with the support base fitting against or slightly into the housing support to provide a stepped appearance. The compact, low-profile configuration of the support base and housing support combination also offers less resistance to wind forces, thereby permitting use of a less substantial pole for a given wind speed rating.

The high mast system of the invention also provides a centering mechanism capable of maintaining coaxial alignment of a luminaire-bearing support base on a pole as said support base is moved along the pole. The centering mechanism comprises a plurality of centering arms disposed at intervals about and mounted to the support base, each of the centering arms being resiliently mounted for pivoting movement so that each arm biases a roller against the pole to maintain the support base in a substantially centered position relative to the pole and to avoid shock to luminaires mounted by the support base. Each centering arm is biased against the pole by means of a spring-loaded piston arm mounted within a cylinder mounted at one end to the support base and at the other end to the centering arm between that end of the arm on which the roller is mounted and the end of the arm mounted to the support base. While a centering mechanism as explicitly disclosed herein is preferred, it is to be understood that centering mechanisms of other configurations including prior art centering mechanisms can be employed.

The present high mast system further provides a ballast housing whereby a remote ballast is mounted directly to a pivotably mounted housing door such that access to the ballast is readily gained by opening of the door. The housing door can be opened rapidly due to secure mounting of the door in place without the use of fasteners such as screws.

Accordingly, it is an object of the invention to provide apparatus for moving along a pole a support base bearing at least one luminaire or the like such as in a high mast lighting system for illuminating roadways and the like, the apparatus being configured to provide an esthetically pleasing appearance of architectural character, the support base being positionable on the pole in relation to a stationary support housing fixed permanently at or near the top of the pole and being dimensioned compactly to permit a low profile appearance having visual appeal.

It is another object of the invention to provide a latching mechanism for releasably latching a support base bearing at least one luminaire or the like to a housing support fixed atop a pole, the support base being moved along the pole to a position whereby the support base is latched to the housing support or associated structure mounted to the pole, the latching mechanism being low cost in manufacture with a high degree of operational reliability, the latching mechanism further being sufficiently compact as to permit a height-wise dimensional reduction such that the latched together combination of the support base and the housing support has a visually pleasing, relatively reduced profile.

It is a further object of the invention to provide a support base and a housing support for a high mast lighting system, the support base and the housing support being box-like in conformation and particularly square in lateral section, the support base bearing at least one luminaire or the like and being movable along a pole to latch to the housing support, the support base fitting against or slightly into the housing support to provide a stepped appearance on latching of the support base to the housing support.

Further objects and advantages of the invention will become more readily apparent in light of the following description of the preferred embodiments of the invention.

DESCRIPTION OF THE PREFERRED EMBODIMENTS

The disclosures of U.S. Pat. Nos. 3,633,980; 3,721,816; 3,847,333; 4,115,845; 4,139,884; 4,149,230; 4,228,488; 4,234,165; 4,348,717; 4,429,355; 4,661,894; 5,718,602; 5,975,726; 6,074,075 and 6,261,122 are incorporated hereinto by reference.

Figure 1:
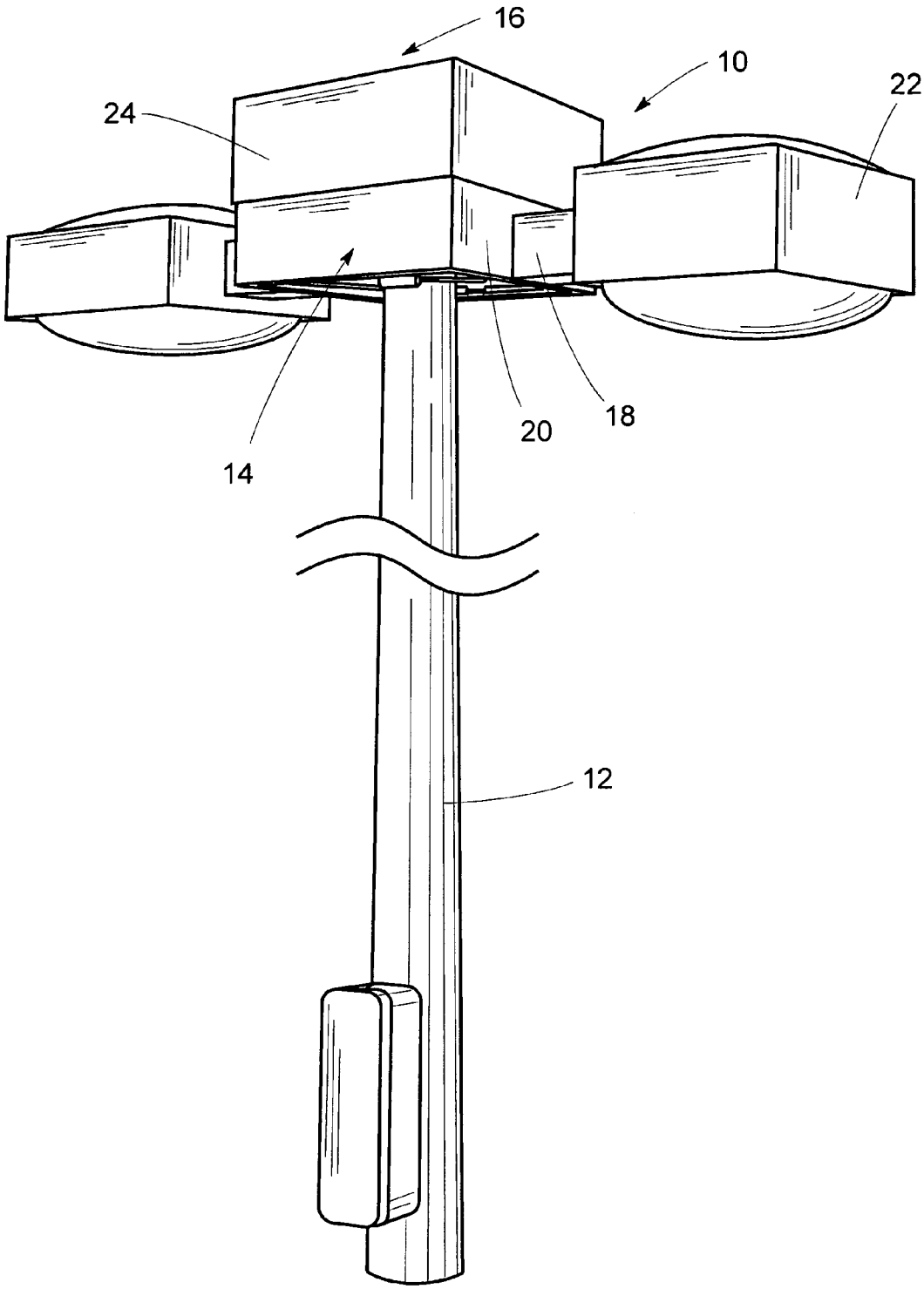
FIG. 1 is a perspective view of a high mast lighting system illustrating architectural detail of the system.
Figure 2:
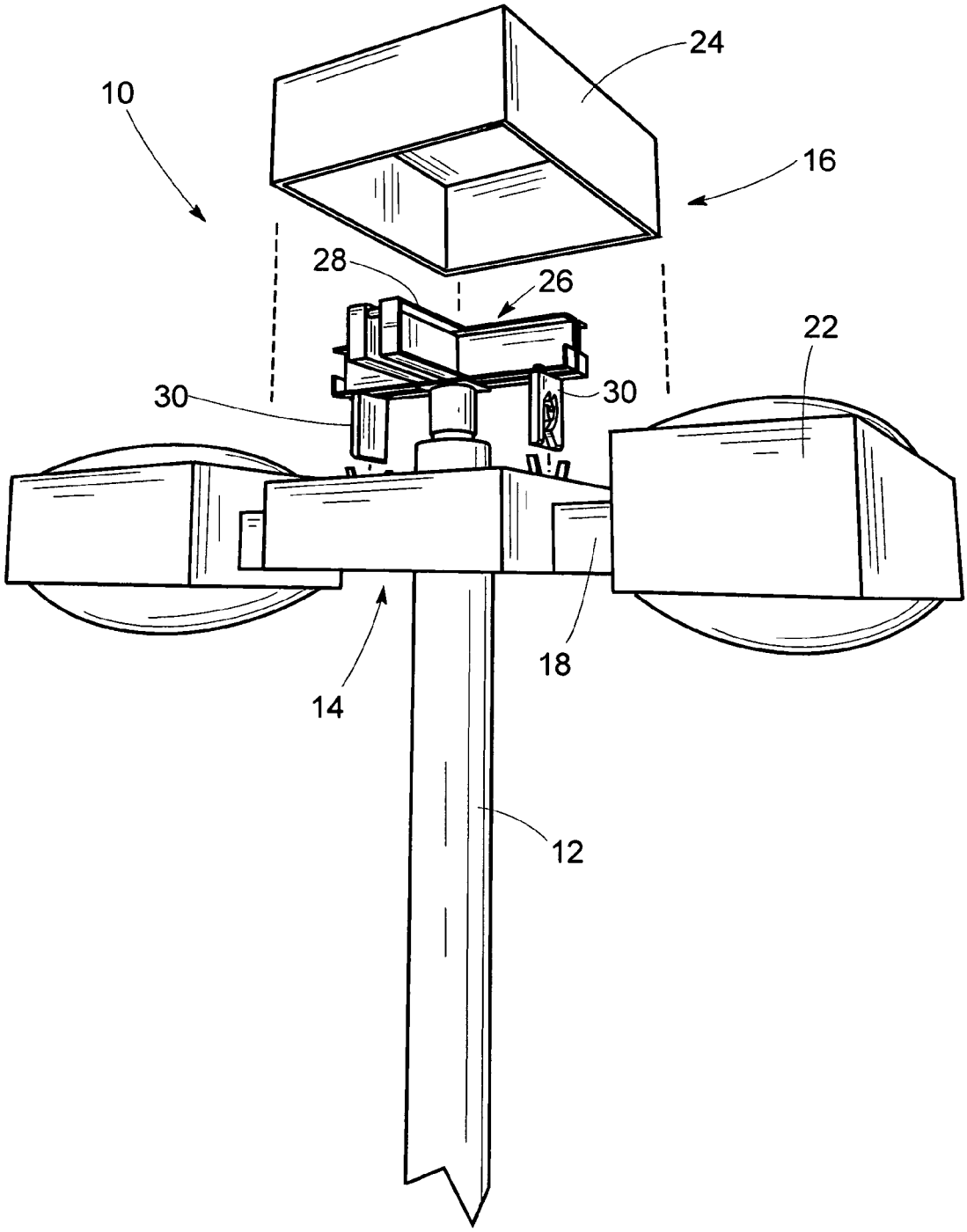
FIG. 2 is an exploded view in perspective of the high mast lighting system of FIG. 1 illustrating the location of a support base disposed along a pole to which a housing support is permanently mounted atop the pole, the support base being spaced from the housing support in an unlatched condition.

Referring now to the drawings and particularly to FIGS. 1 and 2, a high mast system is shown generally at 10 to be operable on a pole 12, the system 10 having an esthetically pleasing appearance due in part to an architectural "feel" evidenced by a stepped juxtaposition of a movable support base 14 with a fixed housing support 16, upper edges of the support base 14 being disposed either immediately adjacent to lower edges of the housing system 16 or slightly inside of said housing support 16. The architectural feel is provided in part by formation of the housing support 16 with greater dimensions permitting a fitting of the support base 14 slightly into an open lower face of the housing support 16 where desired. Whether or not the support base 14 extends slightly into the housing support 16 or is merely raised into adjacent and flush relationship therewith, a stepped appearance results.

Architectural character is also provided by formation of the support base 14 and the housing support 16 as square "boxes" or rectangular solids geometrically, the support base 14 being capable of configuration with a low profile due at least in part to the configuration of latching mechanisms that require less vertical height than is required when latch pin/latch barrel arrangements are used as is common in the prior art. A compact visual character results on latching of the support base 14 to the housing support 16, the system 10 having substantial visual appeal when compared to prior, more bulky high mast systems.

The support base 14 has at least one support arm 18 extending from at least certain of lateral surfaces 20, each support arm 18 terminating in a luminaire 22. Luminaires of varying conformation can be employed in a usual practice of the invention. Further, devices other than luminaires can be mounted to the support arms 18. As will be apparent to those familiar with the art, any reasonable number of luminaires can be mounted to the support base 14 including a single luminaire 22 (not shown). The support arms 18 are preferably formed as enclosed and extended channels or rectangular solids rather than the cylindrical arms often used in conventional high mast systems, the shape of the present support arms 18 lending additional architectural character to the system 10.

The structural elements so disclosed are preferably formed of metal such as stainless steel, polyester powder coated steel, aluminum, etc. Poles useful with the invention are as is commonly used in the art and include round tapered, square tapered, round straight or square straight poles. Pole heights can vary as is common in the high mast art, raising and lowering systems being necessary in applications wherein a luminaire cluster must be raised to an operational position and lowered to a repair or maintenance position. Pole heights are typically on the order of ninety feet or even greater. Luminaire-bearing support rings are typically raised and lowered on poles by means of winch/power apparatus that operate a cable system as is common in the art. Such apparatus need not be described herein since the art is replete with apparatus suitable for such use, the winch/power apparatus and cable system used with the system 10 not being a part of the present invention.

The support base 14 and housing support 16 could be formed as cylinders dimensioned to provide a stepped appearance. However, the box-like rectangular solid conformation of the support base 14 and housing support 16 as illustrated herein provides a more pleasing appearance especially in combination with the shape of the support arms 18 as shown.

As is best seen in FIG. 2, the housing support 16 has a cover 24 disposed over a headframe 26, the cover 24 being the only portion of the housing support 16 that is visible in use. The cover 24 is mounted over the headframe 26 and fixed removably thereto to provide a more esthetic appearance than would the headframe 26 if left uncovered. The headframe 26 is permanently mounted to the distal end of the pole 12, the head frame 26 essentially having a cruciform configuration with arms 28 being conveniently formed of steel channels which, when assembled, provide a conformation similar to that of an I-beam. The headframe 26 mounts cable sheaves (not shown) and associated mechanisms necessary to raising or lowering of the support base 16, such apparatus being substantially conventional in the art.

Figure 4A:
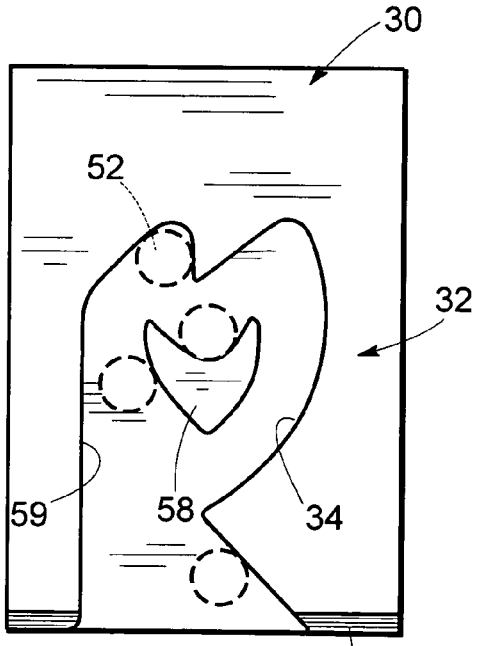
FIGS. 4A through 4C are detail views of the latching mechanism of the invention; and, FIG. 5 is a detail view of a ballast housing.
Figure 4B:
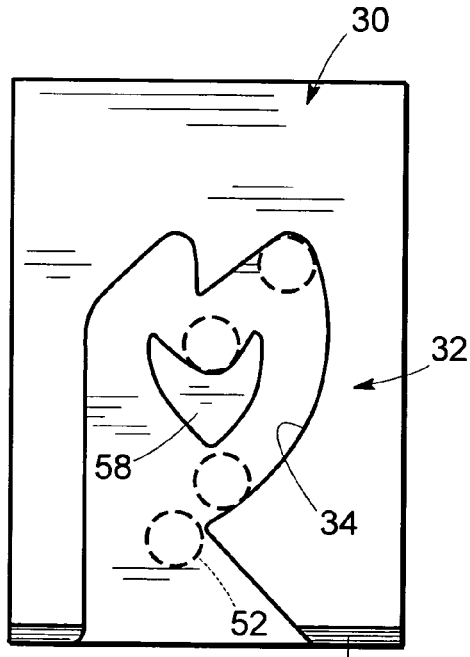

Two oppositely disposed arms 28 of the headframe 26 each respectively mount a cam latch plate 30 inwardly of distal ends of said arms 28, a recessed camming pattern 32 being formed in an outwardly facing surface of each of the latch plates 30 as is best seen in FIGS. 4A and 4B. The latch plates 30 are fixed in place on the headframe 26 and cooperate with structure disposed on the support base 14 to releasably latch the support base 14 to the headframe 26 and thus the housing support 16 as will be described in detail hereinafter.

Figure 3A:
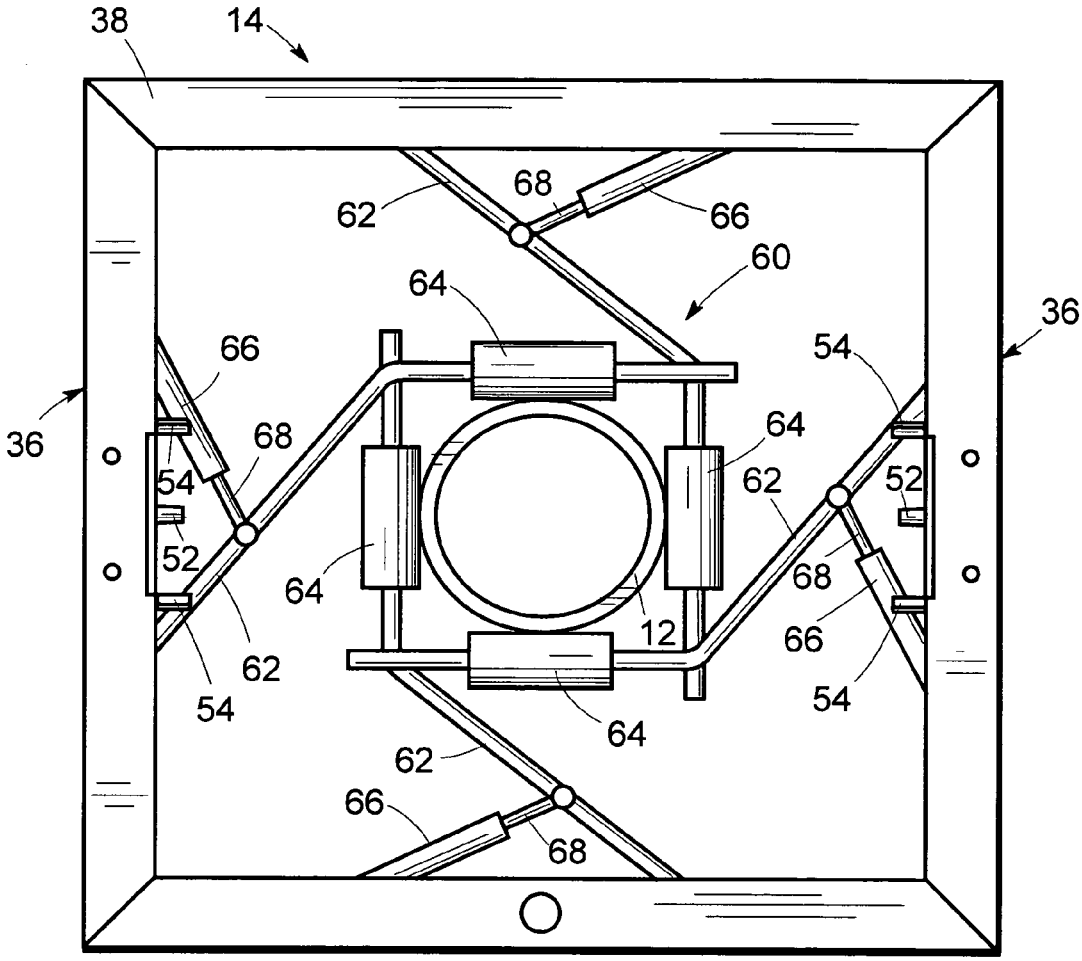
FIG. 3A is a top view of the support base illustrating operational mechanisms contained within the support base.
Figure 3B:
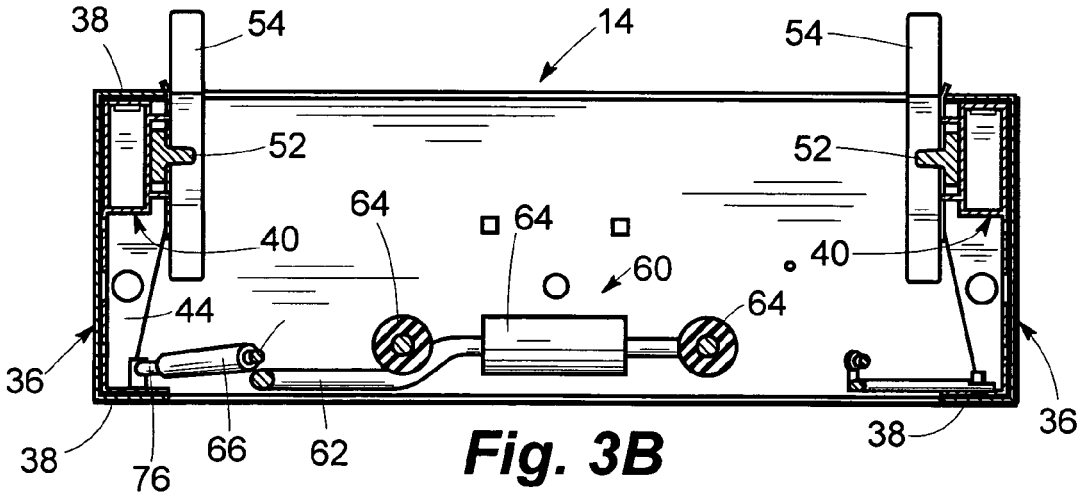
FIG. 3B is an elevational view in section taken through the support base latched to the housing support.

The support base 14 is seen in FIGS. 3A and 3B inter alia to be formed of four channels 36 having inwardly turned edge flanges 38, the channels preferably being fabricated of twelve gauge cold-rolled steel welded together at intersecting corners resulting in the formation of a box-like assembly typically sized to be approximately twenty-six inches on a side and approximately nine inches in height. Conventional angle and plate reinforcements as well as brackets are used to provide adequate strength. Various apertures and the like are formed in the channels 36 to permit cables (not shown) to engage the support base 14 in a conventional manner. One each of the support arms 18 extend from each outer face of each channel 36 in a preferred embodiment.

Figure 3C:
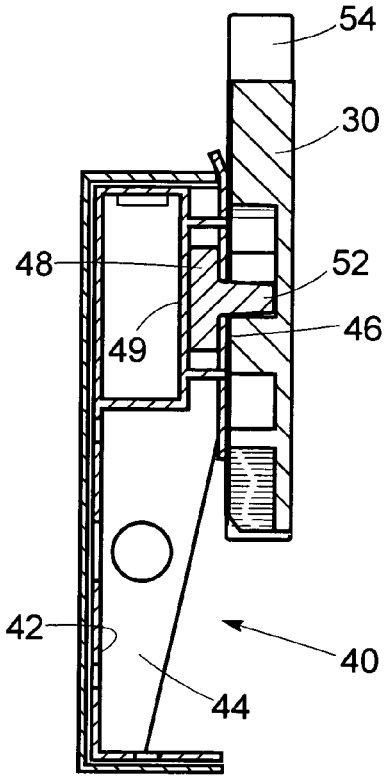
FIGS. 3C and 3D are detail views of a preferred latching mechanism.
Figure 3D:
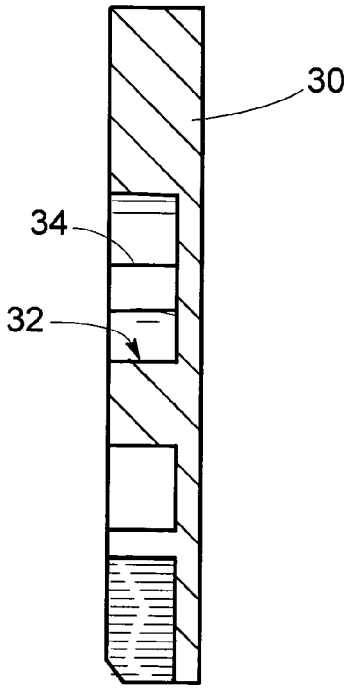
Figure 4C:
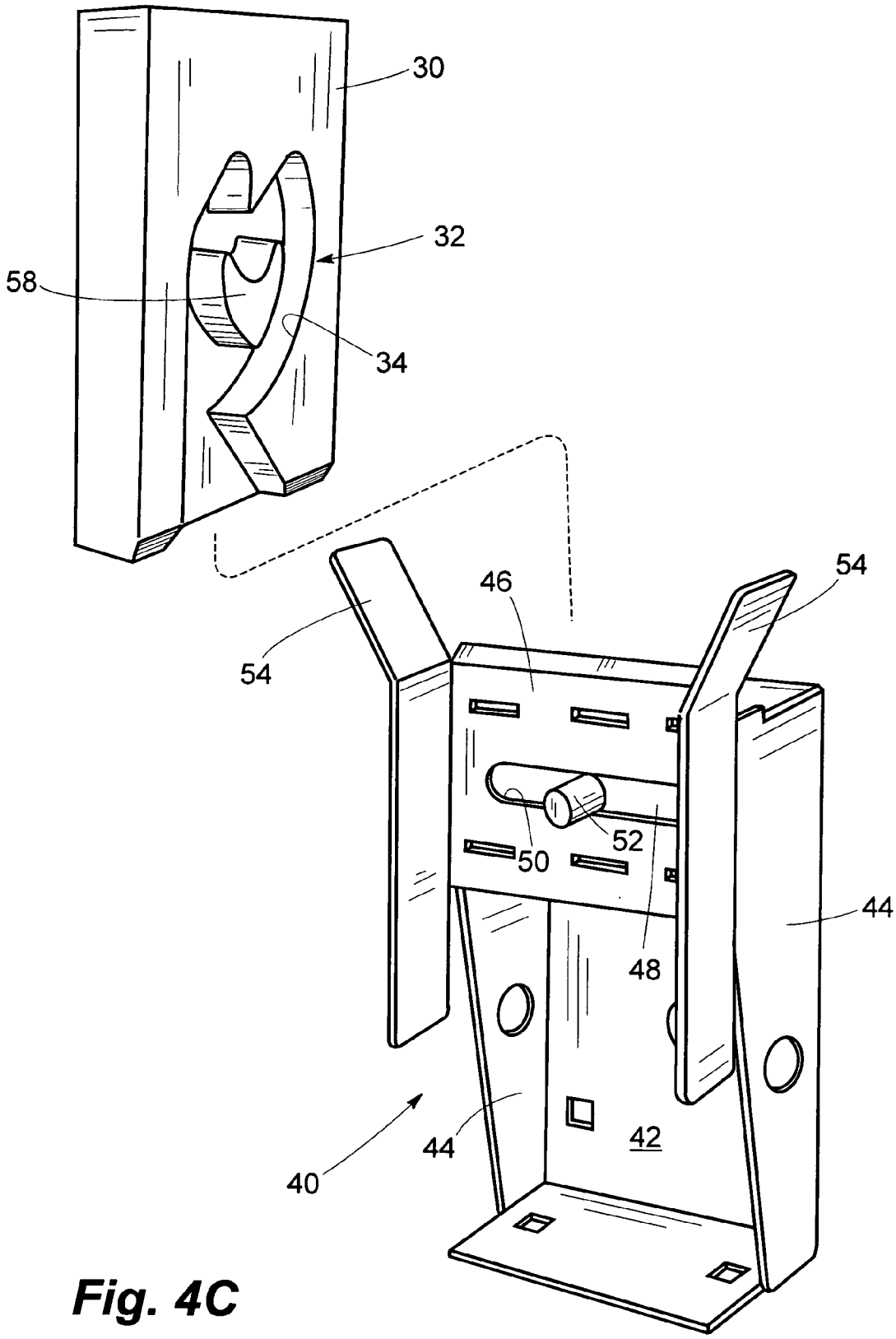

Referring also to FIGS. 3C, 3Ds and 4A through 4C, a latch assembly 40 is seen to be mounted to two opposite channels 36, the latch assembly 40 having a base plate 42 having side flanges 44 that cooperate with housing plate 46 to define a housing within which a slide plate 48 is free to move laterally between the housing plate 46 and a track plate 49 disposed between the base plate 42 and the housing plate 46. The track plate 49 is spaced from the housing plate 46 a sufficient distance to allow free sliding movement of the slide plate 48 therebetween. As is best seen in FIG. 4C, the housing plate 46 has a laterally extending slot 50 formed therein, a cam following pin 52 carried by the slide plate 48 extending through the slot 50 to engage the surfaces 34 of the recessed camming pattern 32 formed in the cam latch plate 30 on raising of the support base 14 along the pole 12. The latch assembly 40 can be configured to operate within a vertical distance of lesser dimension than occurs with commonly available latching mechanisms used in high mast systems, that is, the low profile of the latch assembly 40 permits the support base 14 to have a height dimension that is less than corresponding structure of prior high mast systems. This compact conformation of the support base 14 in addition to the ability to similarly dimension the housing system 16 lends an esthetic appearance to the high mast system 10 in an operational configuration wherein the support base 14 is latched to the housing support 16.

With continuing reference to FIG. 4C in particular, the base plate 42 of the latch assembly 40 is provided with angled guides 54 to facilitate reception of the cam latch plate 30 into functional relation with the latch assembly 40. The camming pattern 32 is seen to be open along lower edge 56 as best seen in FIGS. 4A and 4B to permit receipt of the pin 52 into the recessed camming pattern 32 as the support base 14 is raised along the pole 12. The pattern 32 has a shape similar to an upper case "R", a pattern similar in shape to camming surfaces formed in walls of prior camming latch structures. As is shown in detail in FIGS. 4A and 4B, the pin 52 initially follows an angled portion of the surfaces 34 to enter an arcuate inner portion of the pattern 32, the pin 52 following the arcuate inner portion of the pattern to lodge against within a V-shaped groove of an interior détente 58 as the support base 14 is raised to the operational position relative to the housing support 16. During the latching process, the pin 52 slides within the slot 50 as the slide plate 48 moves laterally of the latch assembly 40 on bias caused by motion of the support base 14.

Unlatching of the support base 14 from the housing support 16 occurs by a further raising of the support base 14 relative to the housing support 16 to cause the pin 52 to move along the surfaces 34 of the camming pattern 32 toward a straight-sided portion 59 thereof to thereby permit the pin 52 to disengage from the cam latch plates 30 on lowering of the support base 14. The support base 14 can then be lowered to ground level for repair, maintenance or replacement of luminaires or the like mounted to the support base 14.

Referring now particularly to FIGS. 3A and 3B, the support base 14 mounts interiorly thereof a centering mechanism 60 having a plurality of centering arms 62 each provided with a roller 64 disposed near the distal end of said arm. Preferably, four of the centering arms 62 are mounted one each to interior walls of each of the channels 36 and centrally of the length of each said channel. The centering arms 62 are each formed of an elongated steel rod bent medially of the length thereof and pivotally mounted at an outer end 76 to one of the corresponding channels 36. A spring-loaded cylinder 66 is also mounted to each of the channels 36 with a piston rod 68 of each said cylinder 66 being pivotally connected to one each of the centering arms 62 at a location inwardly of the point of attachment of the centering arms 62 to the channel 36, such connection not being expressly shown. The cylinder 66 functions to spring-load the centering arm 62 to bias a distal end of said centering arm inwardly toward the pole 12 to engage the roller 64 against the pole 12. The roller 64 carried by each of the centering arms 62 remains in contact with the pole 12 during raising and lowering of the support base 14 whether the pole 12 is round, square, tapered or straight.

While the centering mechanism 60 shown in FIGS. 3A and 3B is preferred, it is to be understood that other centering mechanisms could be employed. Examples of suitable centering mechanisms are shown in certain of the patents incorporated hereinto by reference.

Figure 5:
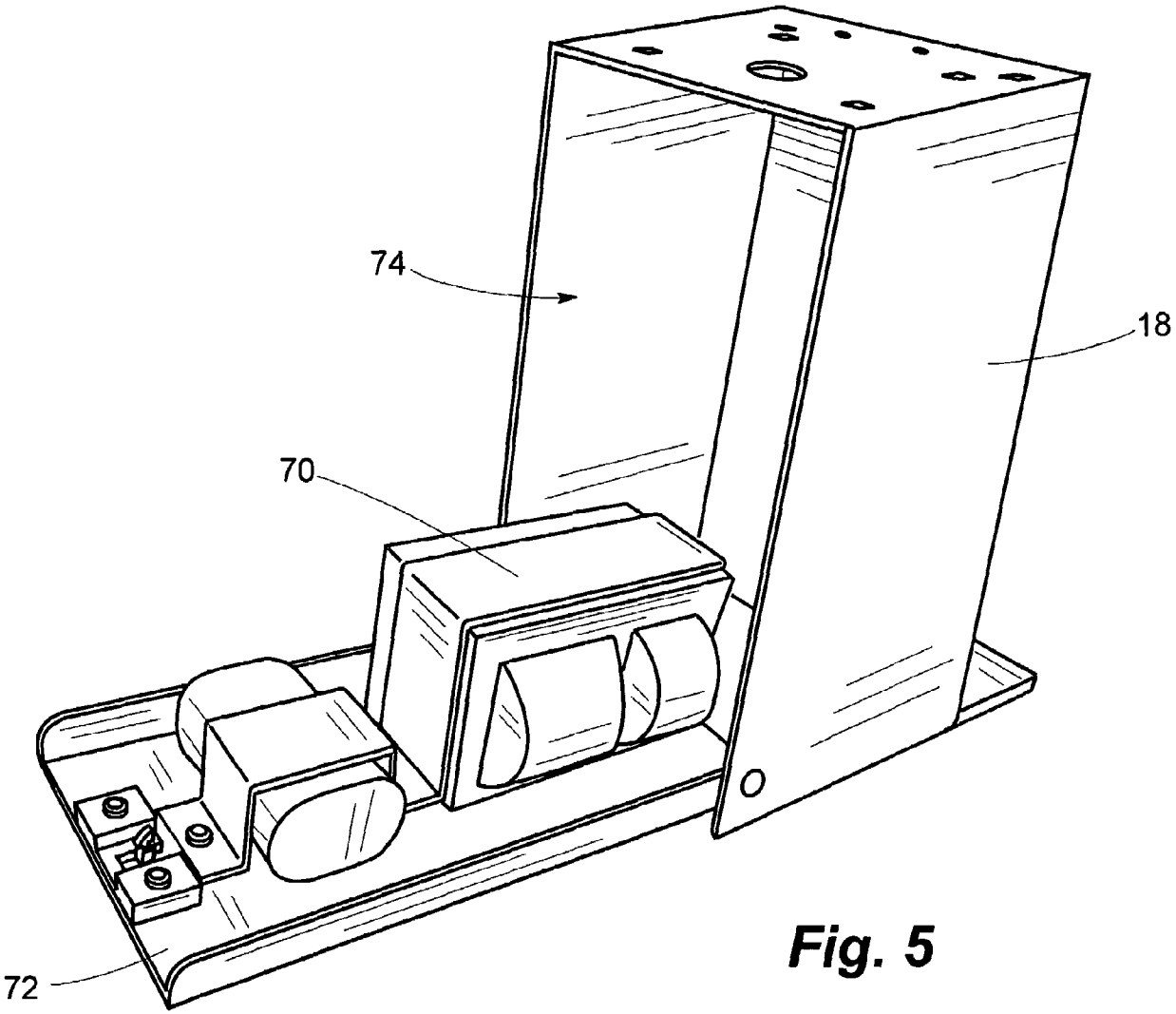

As is seen in FIG. 5, a ballast 70 necessary for operation of the luminaire 22 is mounted to door 72 of a ballast housing 74 formed within one of the support arms 18 so that the ballast 70 is readily exposed on opening of the door 72. The door 72 is pivotally mounted over housing recess (not shown) formed in the support arm 18 and can be positively latched and unlatched by conventional mechanisms without the use of tools. Electrical connection of conventional nature join the ballast 70 to the luminaire 22 and to a power source (not shown). Remote location of the ballast 70 at a distance from the luminaire 22 allows heat generated by the luminaire 22 to dissipate without affecting operation of the ballast.

An indicator (not shown) capable of assuring latching of the support base 12 to the housing support 16 can be employed. Such an indicator can take the form of a "flag" or other device such as is conventional in the art Although the present system 10 has been described relative to particular embodiments thereof, it is to be understood that the invention can be embodied other than is expressly shown and described herein, the scope of the invention being defined by the appended claims.

What is claimed is:

1. A latching mechanism useful in a hoisting system wherein a support base is latched to a stationary structure, the improvement comprising:

at least one latch plate carried by the stationary structure and having a camming pattern formed on a surface of the latch plate; and, a latch assembly carried by the support base and having a latch pin movable laterally to engage the camming pattern formed in the latch plate on raising of the support base into adjacent relation with the stationary structure, the latch assembly comprising housing means carried by the support base for housing the latch pin, the housing means having a slot formed therein through which the latch pin extends and is displaceable within the slot, and slide means moveable within the housing means for mounting the latch pin, the slide means being displaceable laterally within the housing means to permit lateral movement of the latch pin.

2. The latching mechanism of claim 1 wherein a distal end of the latch pin extends toward and into engagement with the camming pattern formed in the latch plate.

3. The latching mechanism of claim 2 wherein the camming pattern is formed in an inwardly facing surface of the latch plate, the distal end of the latch pin entering the camming pattern on raising of the support base into an adjacent relation with the stationary structure.

4. The latching mechanism of claim 3 wherein a portion of the camming pattern in engagement with the latch pin biases said latch pin into an unlatched condition on raising of the latch assembly relative to the latch plate above the latched configuration, thereby to unlatch the latch assembly from the latch plate to permit lowering of the support base relative to the stationary structure.

5. A lighting system having a movable support base latchable to a housing support mounted atop a mast, the movable support base having at least one luminaire mounted thereto, the support base being movable along the mast to engage the housing support by the agency of a hoisting mechanism, the housing support surmounting the support base on engagement therebetween, a latching mechanism comprised of at least one latch plate carried by the housing support and having a camming pattern formed on a surface of the latch plate, a latch assembly carried by the support base and having a latch pin movable laterally to engage the camming pattern formed in the latch plate on movement of the support base into engaging relation with the housing support, the latch assembly further comprising housing means carried by the support base for housing the latch pin, the housing means having a slot formed therein through which the latch pin extends and is displaceable within the slot, and slide means movable within the housing means for mounting the latch pin, the slide means being displaceable laterally within the housing means to permit lateral movement of the latch pin, the housing means having dimensions that are vertically compact thereby permitting the support base and the housing support to be compact vertically on engagement therebetween in adjacent relation and in operational position, the housing support being dimensioned to receive a portion of the support base into a lower opening of the housing support, the latch plate and latch assembly having a low profile by virtue of the lateral motion of the latch pin, thereby permitting the profile of the combination of the support base and the housing support in operational an adjacent position to exhibit a compact and aesthetic as well as a stepped architecturally pleasing appearance.

6. The lighting system of claim 5 and her comprising centering means carried by the support base for maintaining the support base on the mast and for centering the support base on the mast.

7. The lighting system of claim 6 wherein said centering means comprises a plurality of centering arms each having one end pivotally mounted to the support base and a roller carried pivotally at or near the distal end of the centering arm, and means for biasing the centering arm into contact with the mast.

8. The lighting system of claim 7 wherein the means for biasing the roller comprises a spring-loaded cylinder.

9. The lighting system of claim 8 wherein the spring-loaded cylinder comprises a pressurized cylinder and a piston rod extending from the cylinder and biased outwardly of the cylinder by pressure within the cylinder, an end of the cylinder being pivotally mounted to the support base and a distal end of the piston rod being pivotally mounted to the centering arm at a location disposed in proximity to connection of the centering arm to the support base.

10. The lighting system of claim 5 wherein the slot is laterally formed in the housing means.

11. A high mast system having a pole and a support base movable along the pole to raise and lower the support base relative to a housing support mounted atop the pole, comprising:

means carried by the support base for latching to the housing support, the latching means comprising a latch assembly carried by the support base and having a latch pin and a housing means for housing the latch pin, the housing means having a slot formed therein through which the latch pin extends and is displaceable within the slot, and slide means movable within the housing means for mounting the latch pin, the slide means being displaceable laterally within the housing means to permit lateral movement of the latch pin, the housing means having dimensions that are vertically compact thereby permitting the support base and the housing support to be compact vertically when adjacently disposed and in operational position to provide an aesthetically pleasing appearance; and, means carried by the housing support for engaging the latching means carried by the support base to latch the support base to the housing support, the engaging means comprising at least one latch plate having a pattern formed on a surface of the latch plate, the latch pin of the latch assembly being movable laterally to engage the camming pattern formed in the latch plate on raising of the support base into adjacent relation within the housing support, the latch plate and latch assembly having a low profile by virtue of the lateral motion of the latch pin, the housing support being dimensioned to receive a portion of the support base into a lower opening of the housing support, thereby causing the system to have an aesthetic, architecturally significant appearance.

12. The high mast system of claim 11 wherein the slot is laterally formed in the housing means.

* * * * *